US005158348A

United States Patent [19]

Sakamoto et al.

[11] Patent Number: 5,158,348

[45] Date of Patent: Oct. 27, 1992

[54] FLOOD LIGHTING SYSTEM

[75] Inventors: Syoetsu Sakamoto, Hirakata; Kenichi Sasaki, Neyagawa, both of Japan

[73] Assignee: Matsushita Electric Industrial Co., Ltd., Osaka, Japan

[21] Appl. No.: 614,712

[22] Filed: Nov. 16, 1990

[30] Foreign Application Priority Data

Nov. 24, 1989 [JP] Japan ..... 1-305450

[51] Int. Cl.[5] ..... F21V 9/14

[52] U.S. Cl. ..... 362/19; 362/145; 362/147; 359/493; 359/501

[58] Field of Search ..... 362/19, 145, 153, 153.1, 362/147; 350/399, 407, 403; 359/501, 493

[56] References Cited

U.S. PATENT DOCUMENTS

| | | | |
|---|---|---|---|
| 2,260,220 | 10/1941 | Grabau | 350/403 |
| 2,464,954 | 3/1949 | Werth | 350/407 |
| 3,443,855 | 5/1969 | Lend et al. | 350/399 |
| 3,669,526 | 6/1972 | Weiss | 350/407 |
| 4,285,577 | 8/1981 | Schuler | 350/407 |
| 5,033,829 | 7/1991 | Faroughy | 350/407 |

*Primary Examiner*—Richard R. Cole
*Attorney, Agent, or Firm*—Ratner & Prestia

[57] ABSTRACT

A flood lighting system comprising a flood light having a built-in lamp for lighting a building, a polarizer adapted to linearly polarize radiation from the lamp, and an analyzer disposed in such a manner that its direction of oscillation of light is at right angles with that of the polarizer. Thus, the radiation from the flood light does not enter the field of the view of one who looks out from the interior of the building.

9 Claims, 6 Drawing Sheets

FLOOD LIGHTING SYSTEM

FIELD OF THE INVENTION

The present invention relates to a flood lighting system for lighting the exterior of buildings and other structures. More particularly, the invention relates to a flood lighting system which does not cause an objectionable glare to one who looks out from the window of a building.

BACKGROUND OF THE INVENTION

As illustrated in FIG. 6, it is a conventional practice to install a plurality of flood lights 1 around a building of historical note or a building serving as a landmark and to illuminate the exterior of the building with these devices during the night hours. This practice is commonly known as "light-up." A building which is lit in this manner appears as a clear silhouette in the nighttime sky, thus producing a picturesque landscape for those viewing the building from the surroundings.

However, when one within such a building (2) looks out from a window (3) during the light-up time, the light from a flood light may be incident on the eye. This may cause a glare or, in extreme cases, impair one's visual acuity.

To alleviate this phenomenon, it has been proposed that the angle of incidence with the normal be decreased by installing the flood light at the foot of the building. Alternatively, it has been proposed that the angle of incidence with the horizontal be decreased by installing the flood light sideways with respect to the window. However, if the angle of incidence is decreased, either with respect to the normal or with respect to the horizontal, the efficiency in lighting the building (the ratio of the brightness of the building to the projected light flux) tends to decrease, with the result that the freedom of choice in the angle of incidence with the normal or the horizontal was naturally limited.

OBJECTS AND SUMMARY OF THE INVENTION

It is a primary object of the invention to prevent entry of light from a flood light into the field of view of a person who looks out from the window of a building during a light-up time and to eliminate limitations on the installation position of the flood light in regard to the angle of incidence of light with the normal or the horizontal. Thus, it is an object of the invention to allow the flood light to be installed in the position from which the exterior of the building can be lit with the highest possible efficiency.

It is a further object of the invention to reduce the surface reflectance of the window pane of a building and thereby prevent occurrence of the phenomenon in which the window pane alone is visible in reflected light.

It is still another object of the invention to light up a building effectively with an ordinary flood light without providing the flood light with a polarizing means.

It is still another object of the invention to reduce the attenuation of light passing through the window of a building and thereby insure a bright outward look to the building.

It is still another object of the invention to insure linear polarization of light by means of a special lamp and reflector and thereby eliminate the need for installation of a separate polarizing means.

The above-mentioned objects are accomplished by the present invention. The present invention is, therefore, directed to a flood lighting system comprising a flood light having a lamp and a reflector as built therein for lighting the exterior of a building, a polarizer adapted to linearly polarize an emission light from the flood light and an analyzer installed in a position such that the direction of oscillation of light is at right angles with respect to the polarizer. The polarizer and analyzer are installed in an optical path from the lamp to a window of the building to prevent entry of the radiation from the flood light into the field of view of a person who looks out from the window.

In a preferred embodiment of the present invention, the polarizer polarizes the light linearly in a horizontal direction to reduce the surface reflectance of a window pane. In another embodiment, the polarizer is installed in front of the flood light and the analyzer is installed at the window of the building. More particularly, the analyzer is installed at the window to be lit, 1 to 2 meters above flood level, so that the radiation from the floor light will not enter the eye of a person in the building.

In another embodiment, the polarizer is installed so it extends outward from the lower edge of the window in a plane perpendicular to a straight line interconnecting the flood light with the vertical center of the window and over the range defined by the included angle 2*a* between a straight line interconnecting the flood light with the upper edge of the window and a straight line interconnecting the flood light with the lower edge of the window. In this arrangement, even when an ordinary flood light is used, the radiation from the flood light is not incident on the eyes of one who looks out from the window of the building.

In still another embodiment, the polarizer is disposed in front of the lamp and the analyzer is installed so it extends outward from the lower edge of the window over the range defined by the included angle between the line interconnecting the flood light with the upper edge of the window and the line interconnecting the flood light with the lower edge of the window, whereby the loss of light flux is decreased.

In a further embodiment, a flood light comprising a linear tubular lamp and a trough-shaped reflector for projection of a linear polarized radiation is employed. Here, the analyzer is installed in an optical path from the flood light to the building to be lit. Thus, the radiation from the flood light may be prevented from entering the eyes of one who looks out from the window without requiring an independent polarizing means.

DETAILED DESCRIPTION OF THE PREFERRED EMBODIMENTS

Figure 1:
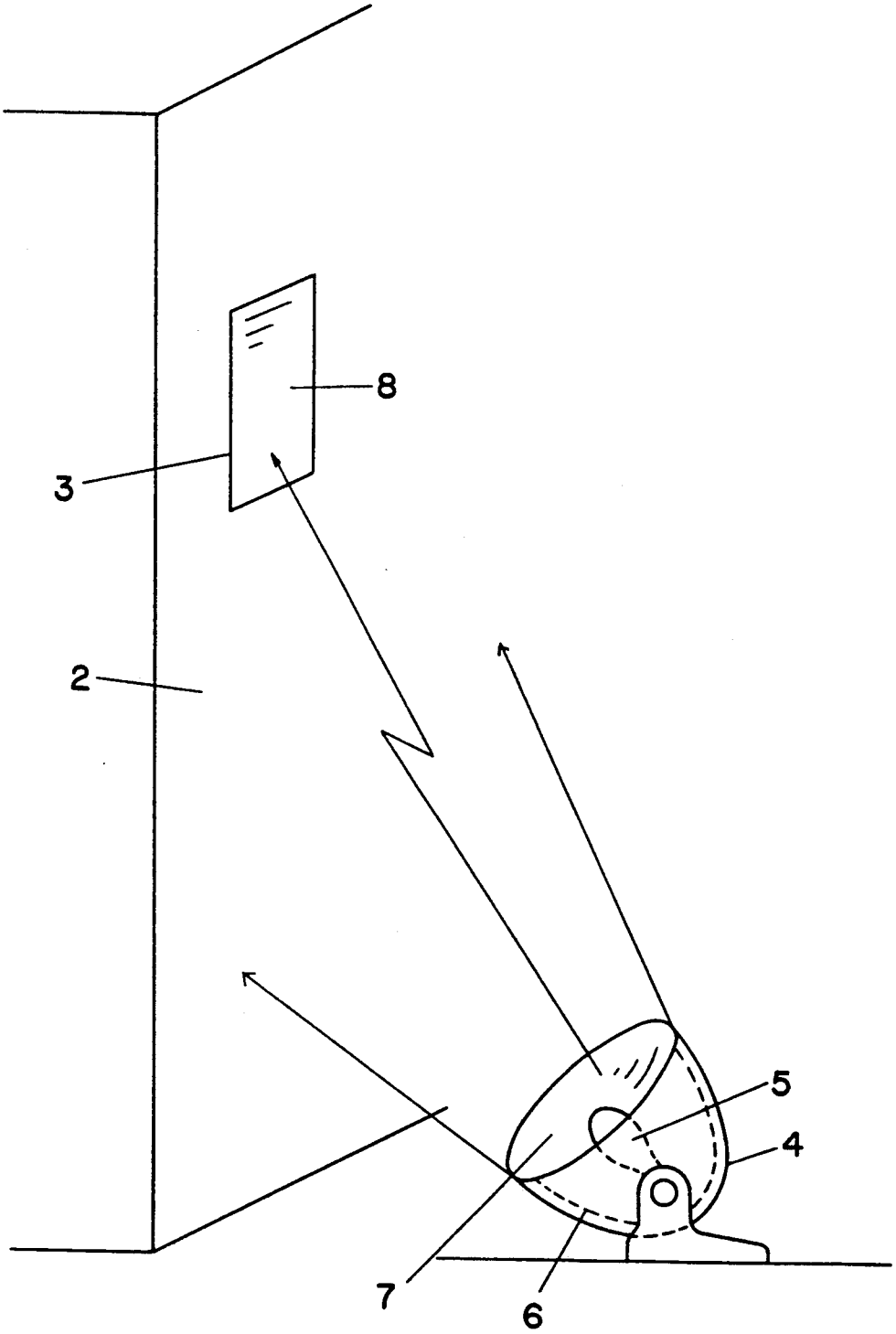
FIG. 1 is a perspective view showing a flood lighting system which embodies the principles of the invention.

An embodiment of the present invention is described in detail below, with reference to FIG. 1.

As illustrated, a flood light 4 comprises a lamp 5, a reflector 6 and a front polarizer 7. The polarizer 7 is adapted to isolate a linear polarized component from the light output of the lamp 5 and may for example be a polarizing prism or a polarizing plate. When the light output of the lamp 5 is projected through the polarizer 7 (either directly or after being reflected by the reflector 6), the projected light is in the form of linearly polarized radiation. An analyzer 8 is installed at the window 3 of a building 2. The analyzer 8 is installed in a relative position with respect to the polarizer 7 so that the directions of oscillation of light are at right angles with each other. In this condition, the polarizer 7 horizontally polarizes the light from the flood light, thus reducing the reflectance of the window 3 when the building 2 is viewed from the outside. In this arrangement, the analyzer 8 is installed in a position where the direction of oscillation will be vertical. The eye level of a person looking out from the window 3 of the building 2 is generally about 1 to 2 meters. Therefore, the analyzer 8 is installed at a height of 1 to 2 meters from the floor on which the window is located.

In the above arrangement, the radiation from the flood light 4 lights the exterior of building 2. However, since this radiation has been linearly polarized and the window 3 is provided with the analyzer 8, no light from the flood light enters the field of view of a person who looks out from the window. For this reason, the flood light can be installed in the position from which the building 2 is lit with the highest possible efficiency.

Figure 2:
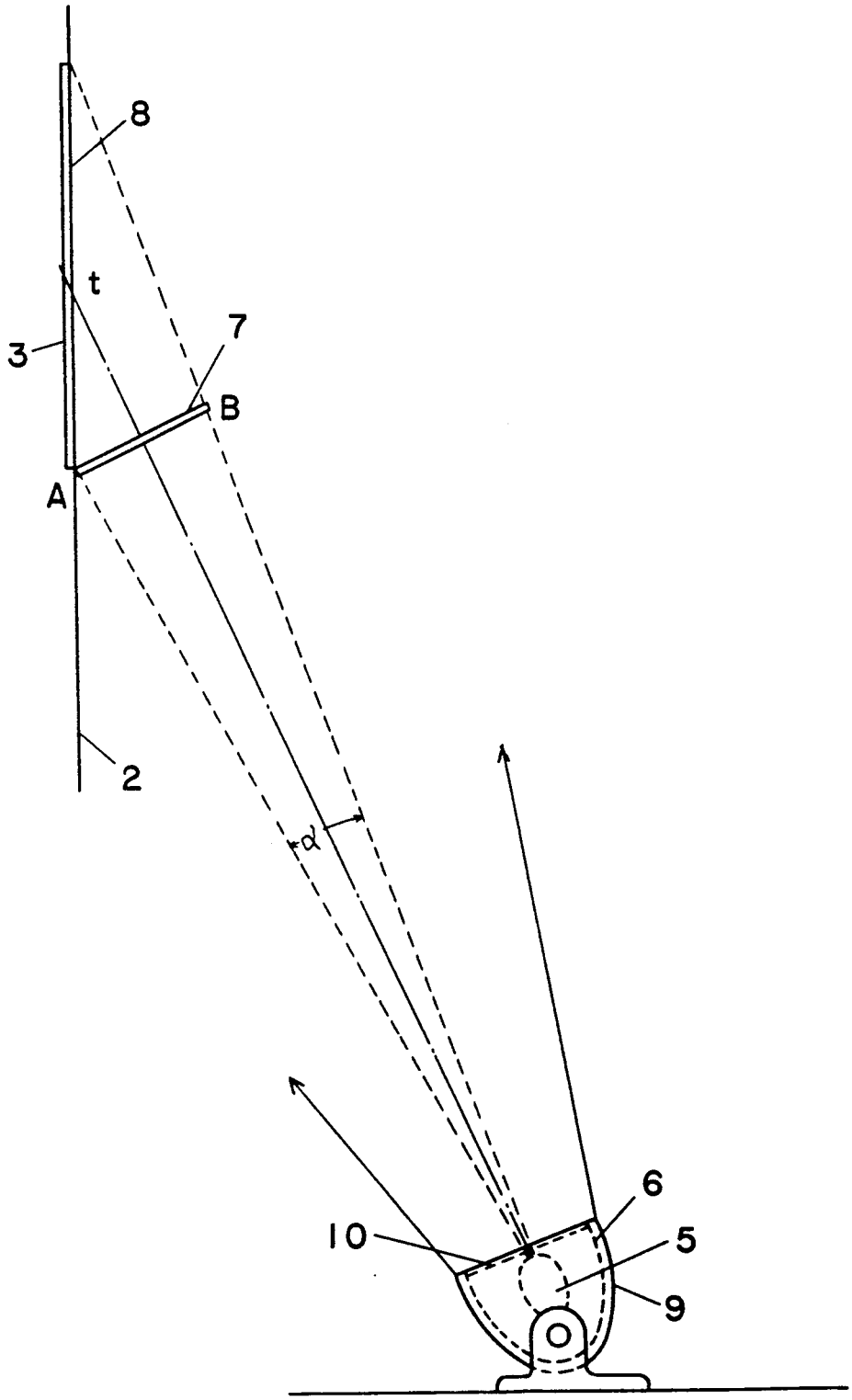
FIG. 2 is a side-elevation view showing another flood lighting system which embodies the principles of the invention.

Another embodiment of the invention is described below, referring to FIG. 2.

As illustrated, a flood light 9 is a usual device comprising a lamp 5, a reflector 6 and a front glass 10. Installed at the window 3 to be lit by the flood light 9 is a polarizer 7 and an analyzer 8. The polarizer 7 is installed in a plane which is perpendicular to a straight line connecting the flood light 9 and the vertical center t of the window 3. In addition, the polarizer is installed over the range of A–B from the lower edge of the window. This range is defined by the included angle $2a$ between a straight line interconnecting the flood light 9 with the upper edge of the window 3 and a straight line interconnecting the flood light 9 with the lower edge of the window 3.

In this embodiment, the objects of the invention can be accomplished with an ordinary flood light 9 by mere modification at the window 3. Moreover, all the surfaces of the building other than the windows can be lit with unpolarized light, with the result that a high lighting efficiency may be obtained.

Figure 3:
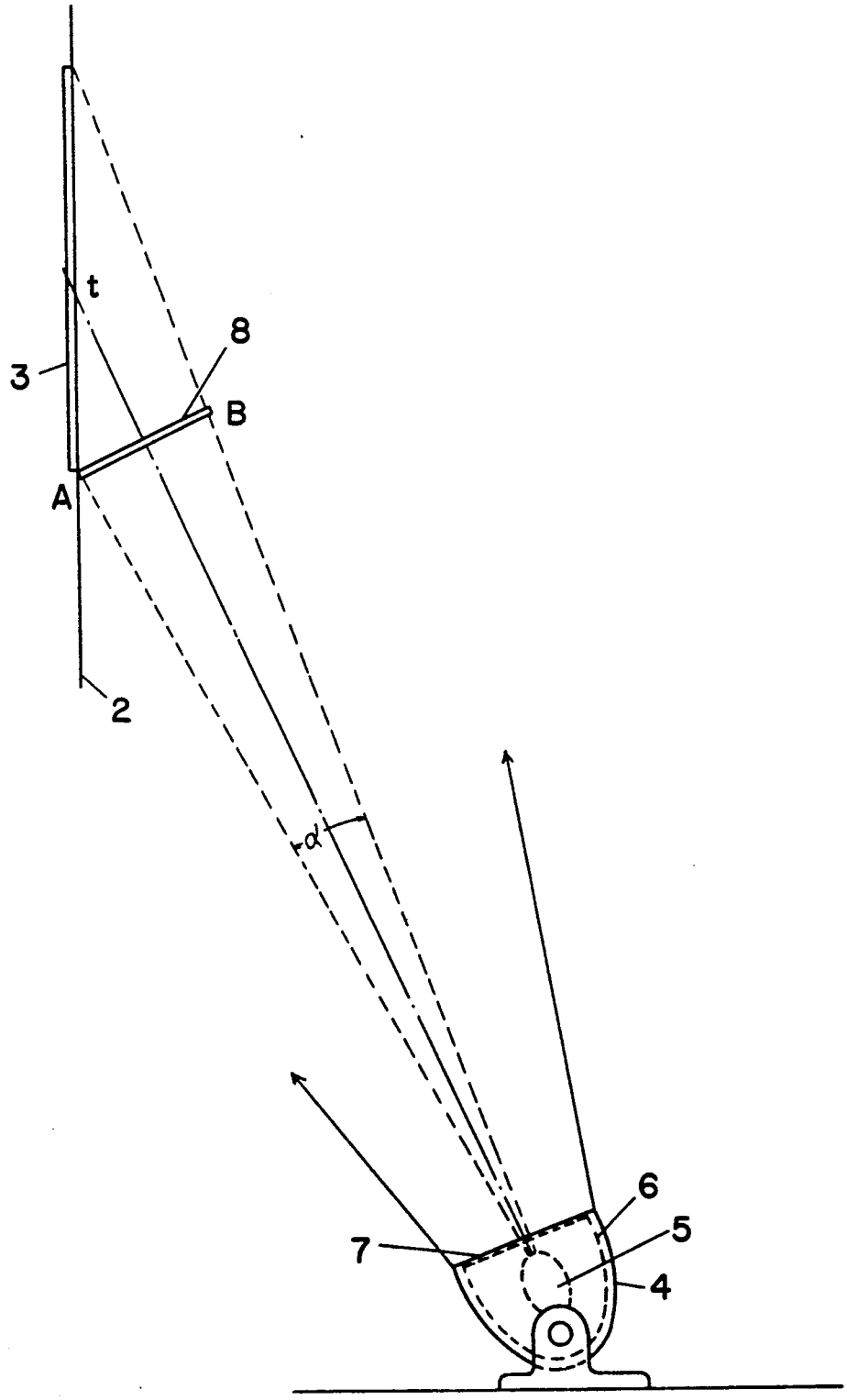
FIG. 3 is a side-elevation of still another embodiment of the invention.

FIG. 3 shows still another embodiment of the present invention.

As illustrated, a flood light 4 is provided with a polarizer 7 in front of a lamp 5 as in the embodiment illustrated in FIG. 1. An analyzer 8 is disposed in the position of installation of the polarizer 7 in the embodiment shown in FIG. 2, and the window 3 has an ordinary glass pane.

In this embodiment, the radiation from the flood light 4 is prevented by the analyzer 8 under the window 3 from entering the field of view. Moreover, since the window 3 is made from ordinary glass, the transmission loss of light is minimal, insuring a bright external look to the building.

Still another embodiment of the present invention is described below, referring FIG. 4.

As illustrated, a flood light 11 comprises a linear tubular lamp 12 and a trough-shaped reflector 13 installed around the linear tubular lamp 12. The radiation from a front glass 14 is linearly polarized in the axial direction of the lamp 12. The window 3 is provided with an analyzer 8.

In this embodiment, the flood light 11 is installed in such a manner that the axis of the linear tubular lamp 12 is generally horizontal, while the analyzer 8 is installed at the window 3 in a position so that the direction of oscillation of light is vertical. In this embodiment, the transmission of light from the flood light 11 through the window pane 3 into the interior of the building 8 is eliminated and, moreover, linearly polarized radiation may be projected from the flood light without using a polarizer.

Figure 5:
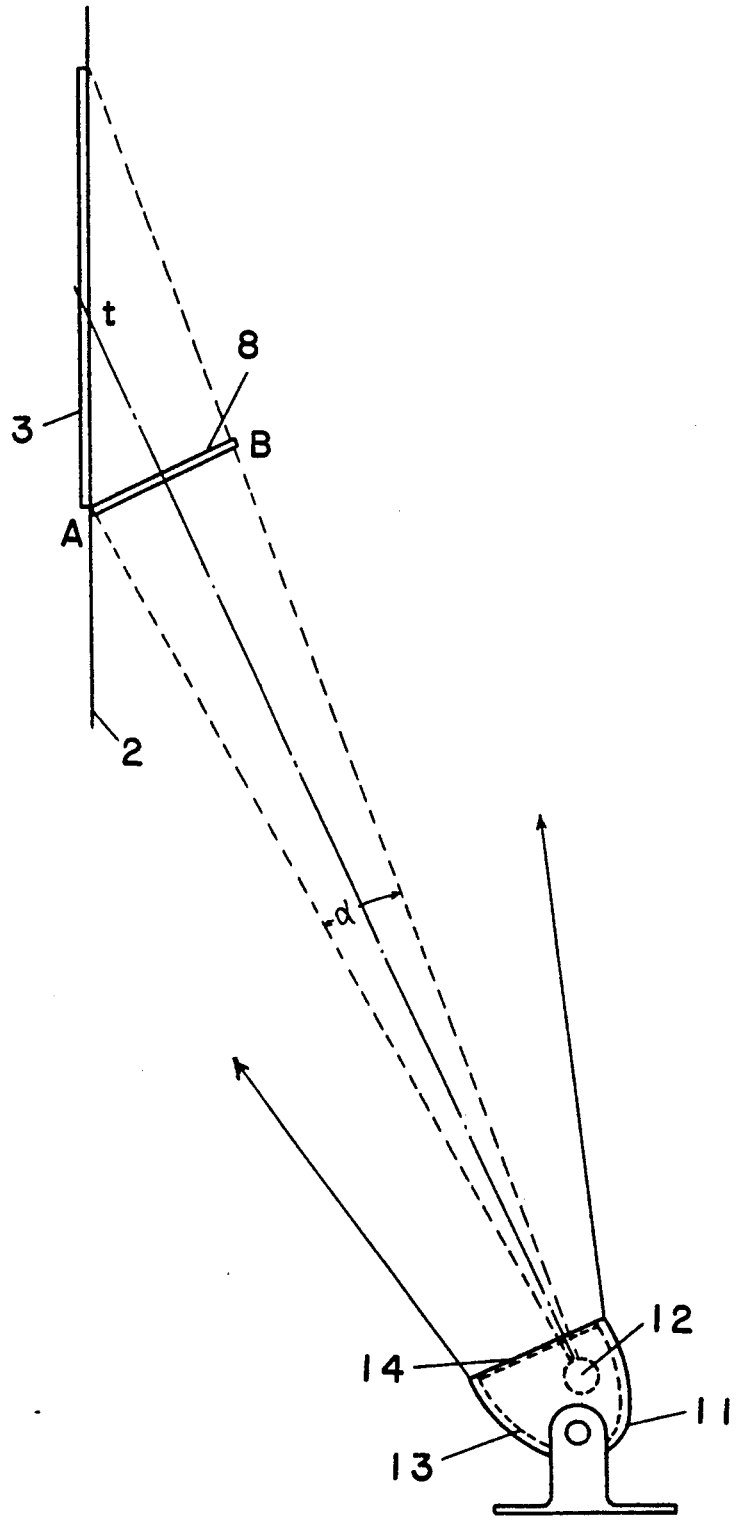
FIG. 5 is a side-elevation view of another embodiment of the present invention.
Figure 6:
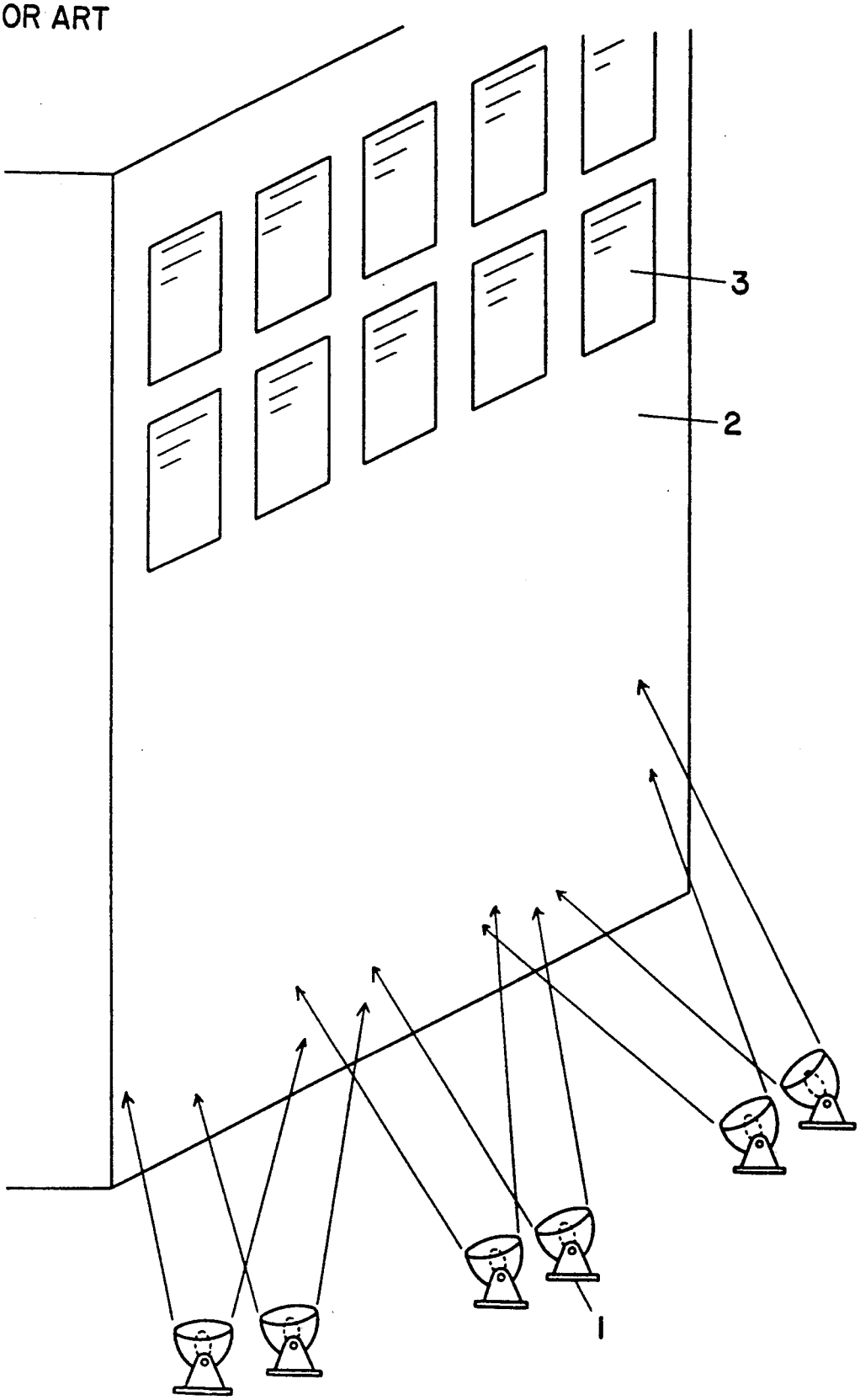
FIG.6 PRIOR ART
FIG. 6 is a perspective view showing a conventional flood lighting device.

Still another embodiment of the invention is described below, referring to FIG. 5.

Figure 4:
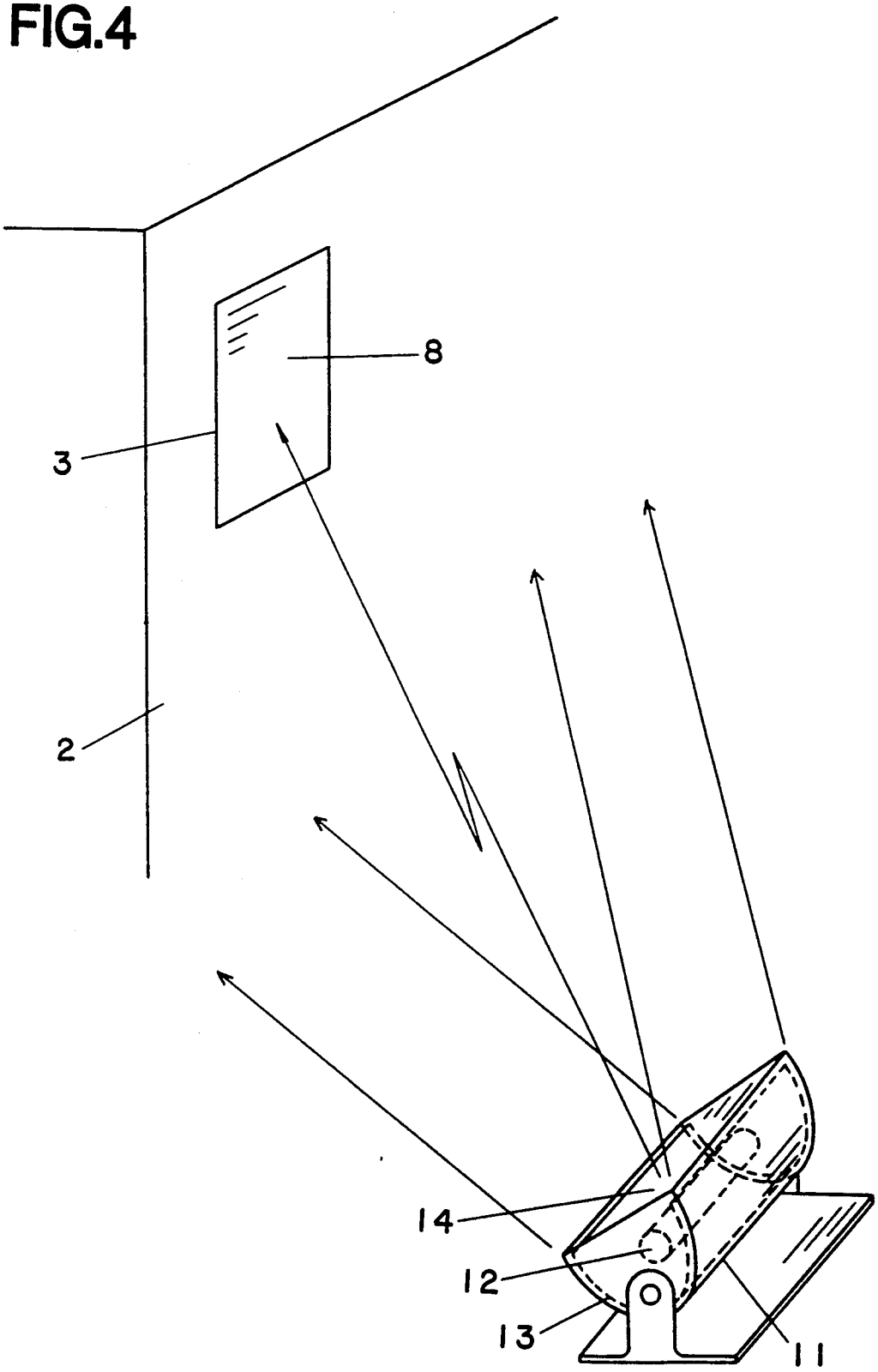
FIG. 4 is a perspective view showing a still further embodiment of the present invention.

As illustrated, a flood light 11 is similar to the one employed in the embodiment of FIG. 4. A polarizer 7 is installed in a plane perpendicular to a straight line interconnecting the flood light 11 with the vertical center t of the window 3. In addition, the polarizer is installed over the range of A–B from the lower edge of the window 3. This range is defined by the included angle $2a$ between a straight line interconnecting the center of the flood light 11 with the upper edge of the window 3 and a straight line interconnecting the flood light 11 with the lower edge of the window 3.

In this embodiment, the radiation from the flood light 11 is prevented by the analyzer 8 from entering the field of view. In addition, window 3 may include a pane which is made from an ordinary grade of glass. Therefore, the transmission loss of light through the window 3 is minimized.

Thus, in accordance with the present invention, employing a polarizer and an analyzer, the radiation from a flood light is prevented from entering the field of view of a person looking out from the window of a building and any limitations on the vertical and horizontal angles of incidence of light with respect to the window are eliminated. Therefore, the flood light may be installed in the position from which the exterior of the building may be lit with the maximum possible efficiency.

While the invention has been described in terms of exemplary embodiments, it is contemplated that it may be practiced as outlined above with modifications within the spirit and scope of the appended claims.

What is claimed is:

1. A flood lighting system comprising a flood light including a lamp and a reflector as built therein and adapted to light a building, polarizing means for linearly polarizing radiation from said lamp, and an analyzer wherein said polarizing means and said analyzer project light having a direction of oscillation and said analyzer disposed in such a relative position with respect to said polarizing means that the direction of oscillation of light of said analyzer is at right angles with respect to the direction of oscillation of said polarizing means, said polarizing means and said analyzer being substantially separated from each other and installed in an optical path from said lamp to a window of the building wherein light from said lamp is prevented from entering the building through the window by means of said polarizing means and said analyzer.

2. The flood lighting system according to claim 1 wherein said polarizing means is adapted to linearly polarize light in a horizontal direction.

3. The flood lighting system according to claim 1 wherein said polarizing means is installed in front of said flood light and said analyzer is installed at the window of the building.

4. The flood lighting system according to claim 3 wherein said analyzer is installed at the window 1 to 2 meters above floor level.

5. The flood lighting system according to claim 1 wherein said polarizing means is installed in a plane perpendicular to a straight line interconnecting said flood light with a vertical center of the window and over a range defined by an included angle between a straight line interconnecting said flood light with an upper edge of the window and a straight line interconnecting said flood light with a lower edge of the window.

6. The flood lighting system according to claim 1 wherein said polarizing means is installed in front of said flood light and said analyzer is installed in a plane perpendicular to a straight line interconnecting said flood light with a vertical center of the window and over a range defined by an included angle between a straight line interconnecting the flood light with an upper edge of the window and a straight line interconnecting said flood light with a lower edge of the window.

7. A flood lighting system according to claim 1 wherein said lamp and said reflector comprise a linear tubular lamp and a trough-shaped reflector for projection of said linearly polarized radiation.

8. The flood lighting system according to claim 7 wherein said analyzer is installed at a window.

9. The flood lighting system according to claim 7 wherein said analyzer is installed in a plane perpendicular to a straight line interconnecting said flood light with a vertical center of the window and over a range defined by an included angle between a straight line interconnecting the flood light with an upper edge of the window and a straight line interconnecting said flood light with a lower edge of the window.

* * * * *